US007189313B2

(12) United States Patent
Lubomirsky

(10) Patent No.: US 7,189,313 B2
(45) Date of Patent: Mar. 13, 2007

(54) SUBSTRATE SUPPORT WITH FLUID RETENTION BAND

(75) Inventor: Dmitry Lubomirsky, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 665 days.

(21) Appl. No.: 10/143,212

(22) Filed: May 9, 2002

(65) Prior Publication Data

US 2003/0209443 A1 Nov. 13, 2003

(51) Int. Cl.
*C25D 17/06* (2006.01)

(52) U.S. Cl. ..... 204/212; 204/275.1; 204/297.01; 204/297.14

(58) Field of Classification Search ..... 204/297.01, 204/297.14, 212, 275.1; 118/500; 134/149, 134/155, 902; 269/55
See application file for complete search history.

(56) References Cited

U.S. PATENT DOCUMENTS

| | | | | |
|---|---|---|---|---|
| 3,727,620 | A | 4/1973 | Orr | 134/95 |
| 3,770,598 | A | 11/1973 | Creutz | 204/52 R |
| 4,027,686 | A | 6/1977 | Shortes et al. | 134/33 |
| 4,092,176 | A | 5/1978 | Kozai et al. | 134/186 |
| 4,110,176 | A | 8/1978 | Creutz et al. | 204/52 R |
| 4,113,492 | A | 9/1978 | Sato et al. | 96/67 |
| 4,315,059 | A | 2/1982 | Raistrick et al. | 429/112 |
| 4,336,114 | A | 6/1982 | Mayer et al. | 204/52 R |
| 4,376,685 | A | 3/1983 | Watson | 204/52 R |
| 4,396,467 | A | 8/1983 | Anthony | 204/15 |
| 4,405,416 | A | 9/1983 | Raistrick et al. | 204/68 |
| 4,428,815 | A | 1/1984 | Powell et al. | 204/297 W |
| 4,435,266 | A | 3/1984 | Johnston | 204/276 |
| 4,466,864 | A | 8/1984 | Bacon et al. | 204/15 |
| 4,489,740 | A | 12/1984 | Rattan et al. | 134/140 |
| 4,496,436 | A | 1/1985 | Inoue | 204/23 |
| 4,510,176 | A | 4/1985 | Cuthbert et al. | 427/82 |
| 4,518,678 | A | 5/1985 | Allen | 430/311 |
| 4,519,846 | A | 5/1985 | Aigo | 134/15 |
| 4,616,596 | A | 10/1986 | Helber, Jr. et al. | 118/603 |
| 4,693,805 | A | 9/1987 | Quazi | 204/192.22 |
| 4,732,785 | A | 3/1988 | Brewer | 427/240 |
| 4,789,437 | A | 12/1988 | Sing et al. | 204/12 |

(Continued)

FOREIGN PATENT DOCUMENTS

| | | |
|---|---|---|
| EP | 1 067 590 | 1/2001 |

(Continued)

OTHER PUBLICATIONS

Abstract of Japanese Application No. 63-118,093, dated May 23, 1988.

(Continued)

*Primary Examiner*—Roy King
*Assistant Examiner*—William T. Leader
(74) *Attorney, Agent, or Firm*—Patterson & Sheridan LLP

(57) ABSTRACT

An apparatus and method for supporting a substrate is provided. In one embodiment, an apparatus for supporting a substrate includes a body having a band extending therefrom. The band is adapted to retain a fluid on the body thereby forming a shallow processing bath for processing the substrate. The band is adapted to deflect under centrifugal force to release the fluid from the substrate as the body is rotated above a predetermined rate.

2 Claims, 6 Drawing Sheets

U.S. PATENT DOCUMENTS 4,839,005 A 6/1989 Katsumoto et al. .... 204/129.46
4,869,971 A 9/1989 Nee et al. ..... 428/635
4,894,260 A 1/1990 Kumasaka et al. ..... 427/241
4,956,056 A 9/1990 Zubatova et al. ..... 204/129.43
5,032,238 A 7/1991 Ishimura et al. ..... 204/129.43
5,039,381 A 8/1991 Mullarkey ..... 204/47.5
5,055,425 A 10/1991 Leibovitz et al. ..... 437/195
5,096,550 A 3/1992 Mayer et al. ..... 204/129.1
5,114,548 A 5/1992 Rhoades ..... 204/129.46
5,141,602 A 8/1992 Chen et al. ..... 205/103
5,155,336 A 10/1992 Gronet et al. ..... 219/411
5,162,260 A 11/1992 Leibovitz et al. ..... 437/195
5,205,082 A 4/1993 Shendon et al. ..... 51/283 R
5,217,586 A 6/1993 Datta et al. ..... 204/129.6
5,222,310 A 6/1993 Thompson et al. ..... 34/202
5,224,504 A 7/1993 Thompson et al. ..... 134/155
5,230,743 A 7/1993 Thompson et al. ..... 134/32
5,252,807 A 10/1993 Chizinsky ..... 219/390
5,256,274 A 10/1993 Poris ..... 205/123
5,256,565 A 10/1993 Bernhardt et al. ..... 437/228
5,259,407 A 11/1993 Tuchida et al. ..... 134/151
5,290,361 A 3/1994 Hayashida et al. ..... 134/2
5,316,974 A 5/1994 Crank ..... 437/190
5,340,370 A 8/1994 Cadien et al. ..... 51/308
5,423,716 A 6/1995 Strasbaugh ..... 451/388
5,452,905 A * 9/1995 Bohmer et al. ..... 279/3
5,522,965 A 6/1996 Chisholm et al. ..... 156/636.1
5,589,224 A * 12/1996 Tepman et al. ..... 427/248.1
5,637,031 A 6/1997 Chen ..... 451/41
5,637,185 A 6/1997 Murarka et al. ..... 438/5
5,664,990 A 9/1997 Adams et al. ..... 451/60
5,683,538 A 11/1997 O'Neill et al. ..... 156/345
5,705,230 A 1/1998 Matanabe et al. ..... 427/438
5,738,574 A 4/1998 Tolles et al. ..... 451/288
5,804,456 A 9/1998 Aintila ..... 437/183
5,807,165 A 9/1998 Uzoh et al. ..... 451/41
5,807,469 A 9/1998 Crafts et al. ..... 204/297 W
5,827,435 A 10/1998 Samukawa ..... 216/69
5,851,140 A 12/1998 Barns et al. ..... 451/288
5,911,619 A 6/1999 Uzoh et al. ..... 451/5
5,972,192 A 10/1999 Dubin et al. ..... 205/101
6,004,880 A 12/1999 Liu et al. ..... 438/692
6,010,964 A 1/2000 Glass ..... 438/692
6,027,630 A 2/2000 Cohen ..... 205/135
6,027,631 A 2/2000 Broadbent ..... 205/137
6,056,864 A 5/2000 Cheung ..... 205/222
6,065,424 A 5/2000 Shacham-Diamand et al. .. 118/696
6,066,030 A 5/2000 Uzoh ..... 451/41
6,090,239 A 7/2000 Liu et al. ..... 156/345
6,126,798 A 10/2000 Reid et al. ..... 204/282
6,143,155 A 11/2000 Adams et al. ..... 205/87
6,156,167 A 12/2000 Patton et al. ..... 204/270
6,159,354 A 12/2000 Contolini et al. ..... 205/96
6,160,703 A * 12/2000 Lopez ..... 361/685
6,162,702 A 12/2000 Morcom et al. ..... 438/459
6,176,992 B1 1/2001 Talieh ..... 205/87
6,179,983 B1 1/2001 Reid et al. ..... 205/96
6,203,684 B1 3/2001 Taylor et al. ..... 205/103
6,241,825 B1 6/2001 Wytman ..... 118/733
6,248,222 B1 6/2001 Wang ..... 204/297.09
6,258,220 B1 7/2001 Dordi et al. ..... 204/198
6,261,433 B1 7/2001 Landau ..... 205/96
6,277,014 B1 8/2001 Chen et al. ..... 451/398
6,280,297 B1 8/2001 Tolles et al. ..... 451/41
6,283,834 B1 9/2001 Liauzu ..... 451/41
6,299,741 B1 10/2001 Sun et al. ..... 204/224
6,376,126 B1 * 4/2002 Faust et al. ..... 429/176
6,398,926 B1 6/2002 Mahneke
6,632,335 B2 10/2003 Kunisawa et al.
2002/0152955 A1 10/2002 Dordi et al.
2003/0181040 A1 9/2003 Ivanov et al.
2004/0052963 A1 3/2004 Ivanov et al.
2004/0084143 A1 5/2004 Ivanov et al.
2004/0094087 A1 5/2004 Ivanov et al.
2004/0094186 A1 5/2004 Ivanov
2004/0097071 A1 5/2004 Ivanov

FOREIGN PATENT DOCUMENTS

JP 58-182823 10/1983
JP 04-131395 5/1992
JP 04-280993 10/1992
JP 06-017291 1/1994
WO 97/12079 4/1997
WO 97/22733 6/1997
WO 99/25902 5/1999
WO 99/25903 5/1999
WO 99/25904 5/1999
WO 99/25905 5/1999
WO 99/26275 5/1999

OTHER PUBLICATIONS

VERTEQ Online, Products Overview, Printed Oct. 27, 1998, 5 pages.
Derwent Abstract of Korean application No. 9500848, dated Feb. 2, 2002.
Sugihara, et al. "Plating Fog Generation in the Forming of Printed Circuits by the Additive Method", *Journal of Applied Electrochemistry*, 27 (9) (Sep. 1997) pp. 1111-1117.
"Wafer Processing", Singer, P., Semiconductor International, Jun. 1998, p. 70.
U.S. Appl. No. 09/476,438 (Dordi, et al.), filed Dec. 30, 1999.
U.S. Appl. No. 10/036,321 (Stevens, et al.), filed Dec. 26, 2001.
U.S. Appl. No. 10/059,572 (Stevens, et al.), filed Jan. 28, 2002.
U.S. Appl. No. 10/038,066 (Chen, et al.), Filed Jan. 3, 2002.
U.S. Appl. No. 09/739,139 (Hsu, et al.), filed Dec. 18, 2000.
U.S. Appl. No. 10/059,851 (Gandikota, et al.), filed Jan. 28, 2002.
U.S. Appl. No. 10/052,015 (Lubomirsky, et al.), filed Jan. 16, 2002.

* cited by examiner

SUBSTRATE SUPPORT WITH FLUID RETENTION BAND

BACKGROUND OF THE INVENTION

1. Field of the Invention

Embodiments of the invention generally relate to a substrate support adapted to retain a liquid on its surface.

2. Background of the Related Art

Integrated circuits have evolved into complex devices that can include millions of transistors, capacitors and resistors on a single chip. The evolution of chip design continually requires faster circuitry and greater circuit density that demand increasingly precise fabrication processes. Two fabrication techniques becoming more frequently used during chip fabrication are plating and electrochemical polishing.

Plating techniques are generally used to deposit conductive materials on a substrate surface. One plating technique is electroless plating. In general, electroless plating is performed by covering a surface with a solution containing metallic ions. The metallic ions attach to the surface through a chemical reduction reaction without the use of electricity. Another plating technique is electroplating. In general, electroplating is performed by applying an electrical bias between an anode and a substrate surface. Conductive material, either from the anode or from an electrolyte solution used to form a conductive path between the anode and the substrate, is deposited on the substrate surface. During plating, the substrate is often rotated or agitated to enhance uniformity of the deposited material.

Electrochemical polishing techniques are generally used to remove conductive material from a substrate surface by electrochemical dissolution. Electrochemical polishing often includes mechanically polishing the substrate with reduced contact force as compared to conventional chemical mechanical polishing processes. Electrochemical dissolution is performed by applying an electrical bias between a cathode and a substrate surface to remove conductive materials from a substrate surface into a surrounding electrolyte used to form a conductive path between the substrate and the cathode. During electrochemical dissolution, the substrate is typically placed in motion relative to a polishing pad to enhance the removal of material from the surface of the substrate.

Systems that perform plating and electrochemical processes may retain the substrate in a face-up orientation during processing. In these systems, the substrate is supported on a platen that is disposed in a basin adapted to hold an electrolyte solution. For electrically driven processes, an electrode (i.e., an anode or cathode) is disposed above the substrate. The basin and platen are flooded with enough electrolyte to establish a conductive path between the electrode and the substrate. A bias is applied between the electrode and the substrate and an electrochemical process (i.e., electroplating and electrochemical dissolution) is performed on the substrate.

As the basin is typically much larger than the substrate being processed, a large volume of electrolyte is utilized to cover the polishing surface and maintain the current paths. High usage of electrolyte contributes to excessive costs of process consumables. As chip fabricators are tending towards processing substrates of larger diameters, the cost of consumables continues to undesirably increase.

Moreover, electrolyte may not always be effectively removed from substrates processed in a face-up orientation, resulting in surface contamination of the substrate. Additionally, if the electrolyte is not removed from the platen after processing, electrolyte may wet the substrate supporting surfaces of the platen after the substrate is removed. Electrolyte, drying on these surfaces, becomes a potential source of substrate scratching and particle generation. Furthermore, if the substrate supporting surface includes electrical contact pads used to bias the substrate, the electrolyte may etch, attack, corrode or deposit on the pads, thus degrading uniform current transfer and disrupting process uniformity across the diameter of the substrate.

Therefore, there is a need for an improved substrate support.

SUMMARY OF THE INVENTION

An apparatus and method for supporting a substrate are generally provided. In one embodiment, an apparatus for supporting a substrate includes a body and an annular band extending from a first side of the body. The first side of the body has a center portion adapted to support the substrate. The annular band is adapted to retain a liquid above the substrate seated on the center portion.

In another embodiment, an apparatus for supporting a substrate includes an annular flange and an annular elastomeric band extending therefrom. The flange has a sealing surface adapted to support the substrate thereon. The band is disposed at an angle between about 0.5 to about 100 degrees relative to the flange and has a distal end that extends to a first elevation of at least 0.5 above the sealing surface. The distal end of the band is adapted to displace to a second elevation of less than about 0 above the sealing surface when subjected to rotation in excess of about 100 revolutions per minute.

In another aspect of the invention, an apparatus for substrate processing is provided. In one embodiment, an apparatus for substrate processing includes a rotatable body, an elastomeric band circumscribing and extending above a center portion of the body, a drive adapted to rotate the body, and fluid delivery system. The fluid delivery system is adapted to flow fluid into a volume defined by the band and the body, wherein the volume is sufficient to immerse a substrate.

In another aspect of the invention, a method for processing a substrate is provided. In one embodiment, a method for an upper surface of a processing substrate includes flowing a fluid onto a substrate supported on a substrate support, the fluid at least partially retained at a level above the substrate by a replaceable band circumscribing the substrate, processing the substrate, and rotating the substrate support to remove the fluid from the wafer surface.

BRIEF DESCRIPTION OF THE DRAWINGS

A more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION OF THE PREFERRED EMBODIMENT

A method and apparatus for supporting a substrate in a processing system is generally provided. Although the invention is described as part of a processing system configured to perform at least one process from the group consisting of plating, electroplating and electrochemical dissolution, the invention may be utilized in other substrate processing applications where fluids are applied to a substrate maintained in a face-up orientation.

Figure 1:
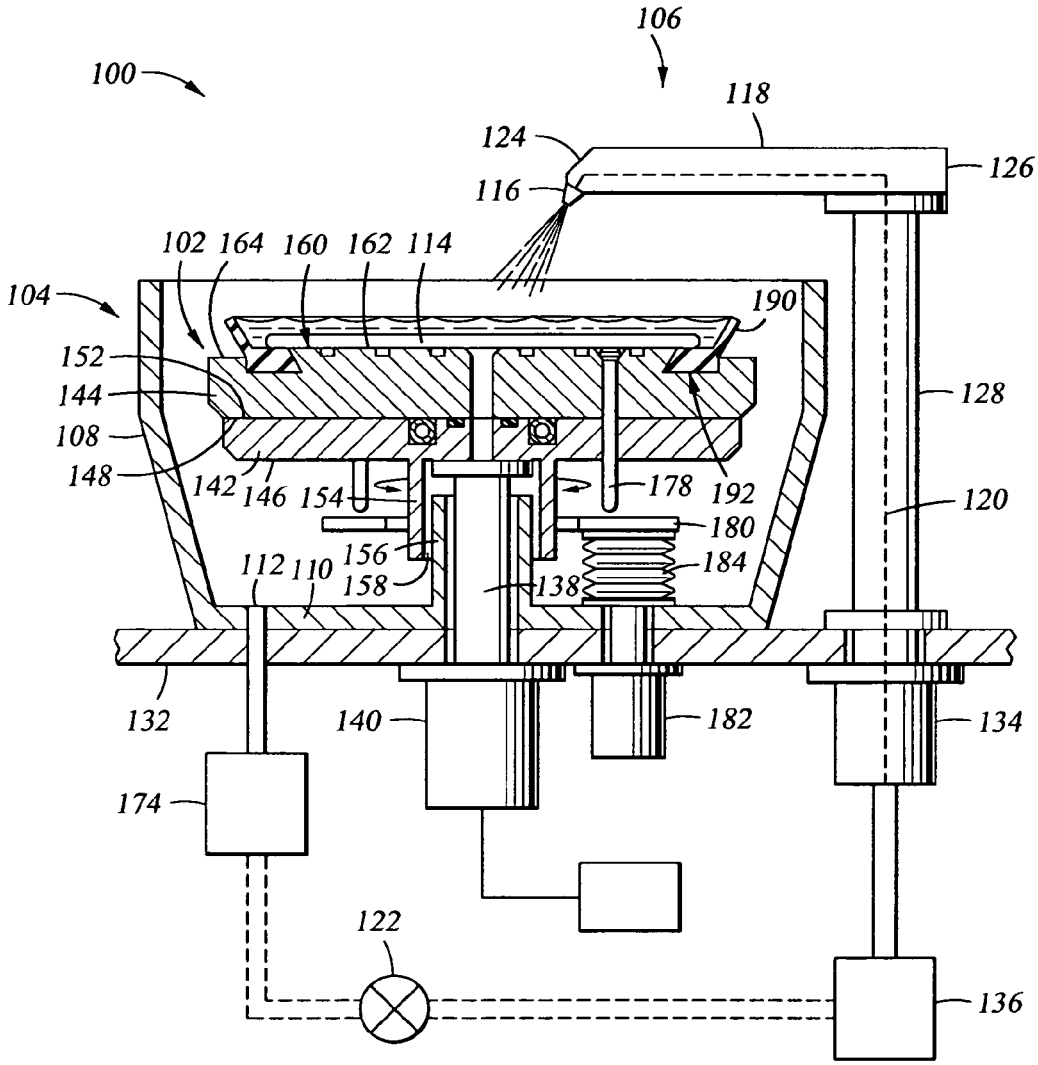
FIG. 1 is a sectional view of one embodiment of a processing cell.

FIG. 1 is a cross sectional view of one embodiment of an electroless plating process cell 100 according to the invention. The processing cell 100 generally includes a substrate support 102, a basin 104 and an electrolyte delivery system 106. The basin 104 is supported on a base 132 of the cell 100 and includes sidewalls 108 and a bottom 110 that define a volume sufficient to accommodate the substrate support 102 therein. The basin 104 is typically fabricated from a material compatible with process chemistries such as metals, ceramics, plastics, including, but not limited to acrylic, lexane, PVC, CPVC, PVDF, polyethylene, stainless steel, nickel or titanium. Alternatively, the basin 104 may be comprised of a material coated with a protective layer, such as a fluoropolymer, PVDF, plastic, rubber and other material compatible with electrolyte or other fluids used. In one embodiment, the basin 104 is electrically insulated from the electrolyte. The basin 104 is sized and adapted to conform to the shape of the substrate support 102 and a substrate 114 being supported thereon, typically circular or rectangular in shape.

The sidewalls 108 extend to an elevation above the substrate support 102 to catch electrolyte being removed from the substrate 114 by centrifugal force. A drain 112 is formed through the bottom 110 of the basin 104 to remove electrolyte from the basin 104. Electrolyte removed from the basin 104 is typically collected in an electrolyte reclamation system 174 for recycling or disposal of the electrolyte.

The electrolyte delivery system 106 includes a nozzle 116 coupled to an arm 118 that is adapted to provide electrolyte to the substrate 114 during processing. The nozzle 116 is generally disposed at a distal end 124 of the arm 118. A second end 126 of the arm 118 is coupled to a stanchion 128. The stanchion 128 is generally configured to support the arm 118 above the sidewalls 108 of the basin 104. The stanchion 128 is coupled to a rotary actuator 134 through the base 132. The rotary actuator 134 is adapted to swing the arm 118 between positions over and clear of the basin 104 to provide access to the substrate support 102 and facilitate substrate transfer.

The electrolyte delivery system 106 also includes an electrolyte source 136 that supplies electrolyte used to process the substrate 114. The electrolyte source 136 is coupled to the nozzle 116 by a supply line 120 that is routed through or along the stanchion 128 and arm 118. The choice of electrolyte utilized varies according to the electrochemical process being performed. In one embodiment, an electroless plating process is performed utilizing a suitable electrolyte, for example, solutions containing at least one metal such as TiN, palladium or copper. In alternative embodiments, the electrolyte may be $H_2SO_4$ $CuSo_4$ in aqueous solution.

Optionally, a pump 122 may be disposed between the electrolyte source 136 and the electrolyte reclamation system 174 to recirculate electrolyte through the cell 100. In such a configuration, the electrolyte reclamation system 174 may include filters or other devices for removing contaminants from the electrolyte returning from the basin 104 through the drain 112.

The substrate support 102 is supported within the basin 104 by a shaft 138. The shaft 138 is coupled to a rotary actuator 140 disposed below the basin 104. The rotary actuator 140, which may be an electric, pneumatic or hydraulic motor, is coupled to the base 132 and is adapted to rotate and/or oscillate the substrate support 102 during processing and removal of electrolyte from the substrate 114.

A plurality of lift pins 178 are disposed through the substrate support 102 and are adapted to place the substrate in a spaced-apart relationship to the substrate support 102 to facilitate substrate transfer. An actuator 182, typically coupled to and disposed below the base 132, is coupled to an annular lift plate 180 that is disposed within the basin 104. The lift plate 180 is elevated by the actuator 182 to contact the lift pins 178, thereby extending the lift pins 178 above the substrate support 102 to lift the substrate 114. Typically, a bellows 184 is disposed between the basin 104 and the actuator 182 (or lift plate 180) to prevent electrolyte from leaking from the basin 104.

The substrate support 102 typically includes a base portion 142 and a support body 144. The base portion 142 is generally coupled to the shaft 138 on a first side 146 and coupled to a first side 152 of the support body 144 on a second side 148. The base portion 142 is typically comprised of a rigid material such as PFFK or stainless steel or other material inert to process chemistries. The base portion 142 may be comprised of other materials that are coated with a material inert to process chemistries.

A skirt 154 extends from the first side 146 of the base portion 142 towards the bottom 110 of the basin 104. The skirt 152 circumscribes a ring-shaped flange 156 extending upwards from the bottom 110 of the basin 104 to form a labyrinth gap 158 that prevents electrolyte from inadvertently flowing out of the basin 104 from around the shaft 138.

The support body 144 includes a second side 160 disposed opposite the first side 152. The second side 160 includes a central portion 162 circumscribed by a peripheral flange 164. The central portion 162 is orientated generally perpendicular to an axis of rotation of the substrate support 102. The central portion 162 is adapted to support the substrate 114 thereon and, in one embodiment, is raised relative to the flange 164.

A band 190 is coupled to the support body 144 and circumscribes the central portion 162 and is adapted to retain the electrolyte in a shallow pool above the substrate 114 during processing. In one embodiment, the band 190 may be deformed or change orientation when subjected to centrifugal force to release the electrolyte retained by the band 190 during processing. The band 190 is typically fabricated from an elastomeric material compatible with process chemistries, for example, fluorocarbon or other flexible material based per fluorocarbons. In embodiments where the band 190 is not required to move to allow release of electrolyte, the band 190 may be fabricated from other materials compatible with process chemistries, for example, materials suitable for fabrication of the basin 104.

Figure 2:
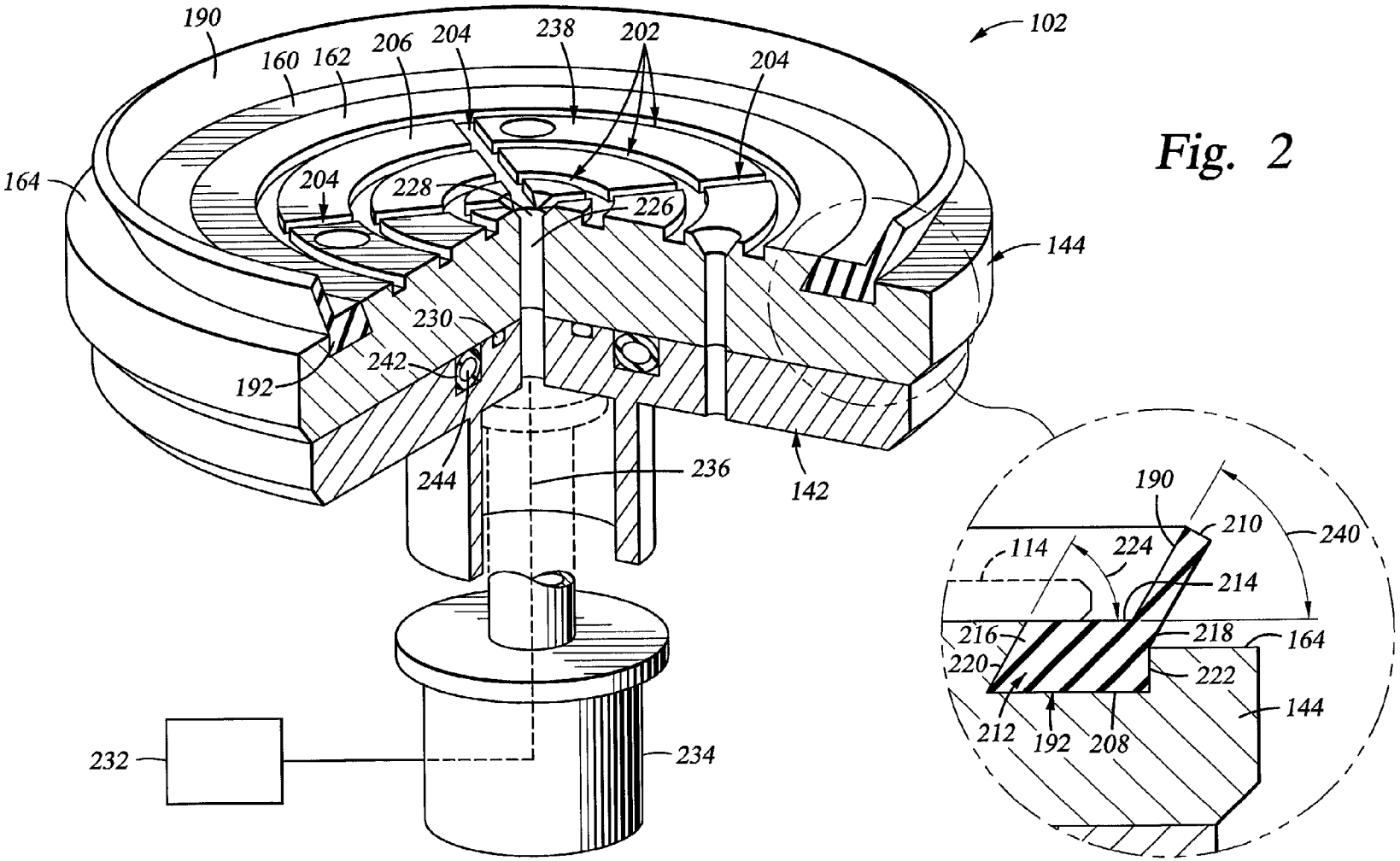
FIG. 2 is a sectional isometric view of one embodiment of a substrate support.

FIG. 2 depicts a sectional isometric view of one embodiment of the band 190. The band 190 is generally annular in shape. The band 190 includes a first end 208 that is disposed in a groove 192 formed in the second side 160 of the support body 144 between the central portion 162 and the peripheral flange 164. The first end 208 includes a flange 212 extending radially inward of the band 190. The flange 212 is typically annular as shown, but may alternatively cover the central portion 162 of the substrate support 102. The flange 212 has a sealing surface 214 that extends slightly above the central portion 162 to support the substrate 114 (shown in phantom) at its perimeter. The sealing surface 214 provides a vacuum seal between the band 190 and the substrate 114 that allows a vacuum applied between the central portion 162 and the substrate 114 to secure the substrate 114 to the substrate support 102 (i.e., the sealing surface 214 facilitates vacuum chucking of the substrate 114).

The flange 212 includes a first side 216 and a second side 218 that interface with the slot 192 formed in the support body 144 to prevent the band 190 from disengaging the substrate support 102 during rotation. The slot 192 includes a first wall 220 disposed at an angle 224 relative to the central portion 162 to create an undercut within the slot 192 that retains the first side 216 of the flange 212. In one embodiment, the angle 224 is between about 30 to about 90 degrees. The second wall 222 of the slot 192 is typically generally perpendicular to the central portion 162. The second wall 222 abuts against a second side 218 of the flange 212 and prevents the band 190 from becoming disengaged from the substrate support 102 as the substrate support rotates. The second side 218 of flange 212 is typically longer than the second wall 222 to facilitate outward movement of the band 190 when rotated as described below.

The second end 210 of the band 190 is configured to project to an elevation above the substrate 114 seated on the central portion 162 to create a shallow pool of electrolyte over the substrate 114. The second end 210 of the band 190 is disposed at an elevation relative to the central portion 162 that retains enough electrolyte behind the band 190 to immerse the substrate 114. In one embodiment, the elevation of the second end 210 is high enough to retain electrolyte during oscillations and slow rotation of the substrate support 102. The second end 210 of the band 190 typically defines an angle 240 between 100 to 5 degrees relative to the central portion 162 of the substrate support 102. In one embodiment, the elevation of the second end 210 of the band 190 ensures that the band 190 holds enough volume of electrolyte to cover the substrate 114 for electrochemical or other wet processing of the substrate. Optionally, the elevation of the second end 210 may extend high enough to allow slow rotation or oscillation of the substrate support 102 without spillage of the electrolyte over the band 190. For example, the elevation of the second end 210 of the band 190 may be about 0.5 mm to about 50 mm above the central portion 162. Since the volume of electrolyte retained by the band 190 is much smaller than the volume of the basin 104, substantially less electrolyte is used during processing in comparison to conventional electrochemical systems.

A vacuum passage 226 is generally disposed through the support body 144 and the base portion 142. The vacuum passage 226 couples a vacuum port 228 formed in the central portion 162 to a vacuum line 236 routed through the shaft 138 to a vacuum source 232. The vacuum line 236 includes a rotary union 234 disposed between the shaft 138 and vacuum source 232 to facilitate gas-tight coupling of the vacuum source 232 and passage 226 while the substrate support 102 is rotating. A seal 230 is provided between the support body 144 and the base portion 142 to prevent vacuum leakage from the passage 226. The vacuum source 232 is adapted to provide a vacuum in an interstitial space defined between the substrate 114 and the central portion 162 of the support body 144, thereby securing the substrate 114 to the substrate support 102. The central portion 162 may include a patterned surface 238 adapted to uniformly distribute the vacuum radially outward from the vacuum port 228 along the central portion 162. The uniformity of the vacuum between the substrate 114 and substrate support 102 results in improved chucking of the substrate and process uniformity.

The patterned surface 238 generally includes a network of channels, grooves and/or recesses that distributes vacuum radially from the port 228. In the embodiment depicted in FIG. 2, the patterned surface 238 has a plurality of concentric channels 202 connected to the port 228 by a plurality of radial channels 204. The channels 202, 204 define a plurality of substrate support islands 206 that support the substrate 114. A ratio of channel to island area may be selected to provide adequate vacuum force distribution across the substrate while maintaining substrate flatness. The ratio may also be selected to control heat transfer to or from the substrate. The size and shape of the channels 202, 204 and islands 206 may be configured alternatively.

A temperature device may be imbedded in the substrate support 102 to control the temperature of the substrate seated thereon. In one embodiment, the substrate support 102 includes a conduit 244 disposed between the support body 144 and the base portion 142. The conduit 244 is adapted to flow a heat transfer fluid therethrough to regulate the temperature of the substrate. The conduit 244 may alternatively be a resistive heater or other cooling or heating device.

In the embodiment depicted in FIG. 2, the conduit 244 is disposed in a groove 242 formed in the base portion 142 of the substrate support 102. A diameter of the conduit 244 is slightly greater than a depth of the groove 242 to ensure good thermal contact with the substrate support 102 as the base portion 142 and support body 144 are urged together. Alternatively, the groove 242 may be formed in the support body 144, or in both the support body 144 and base portion 142.

Figure 3:
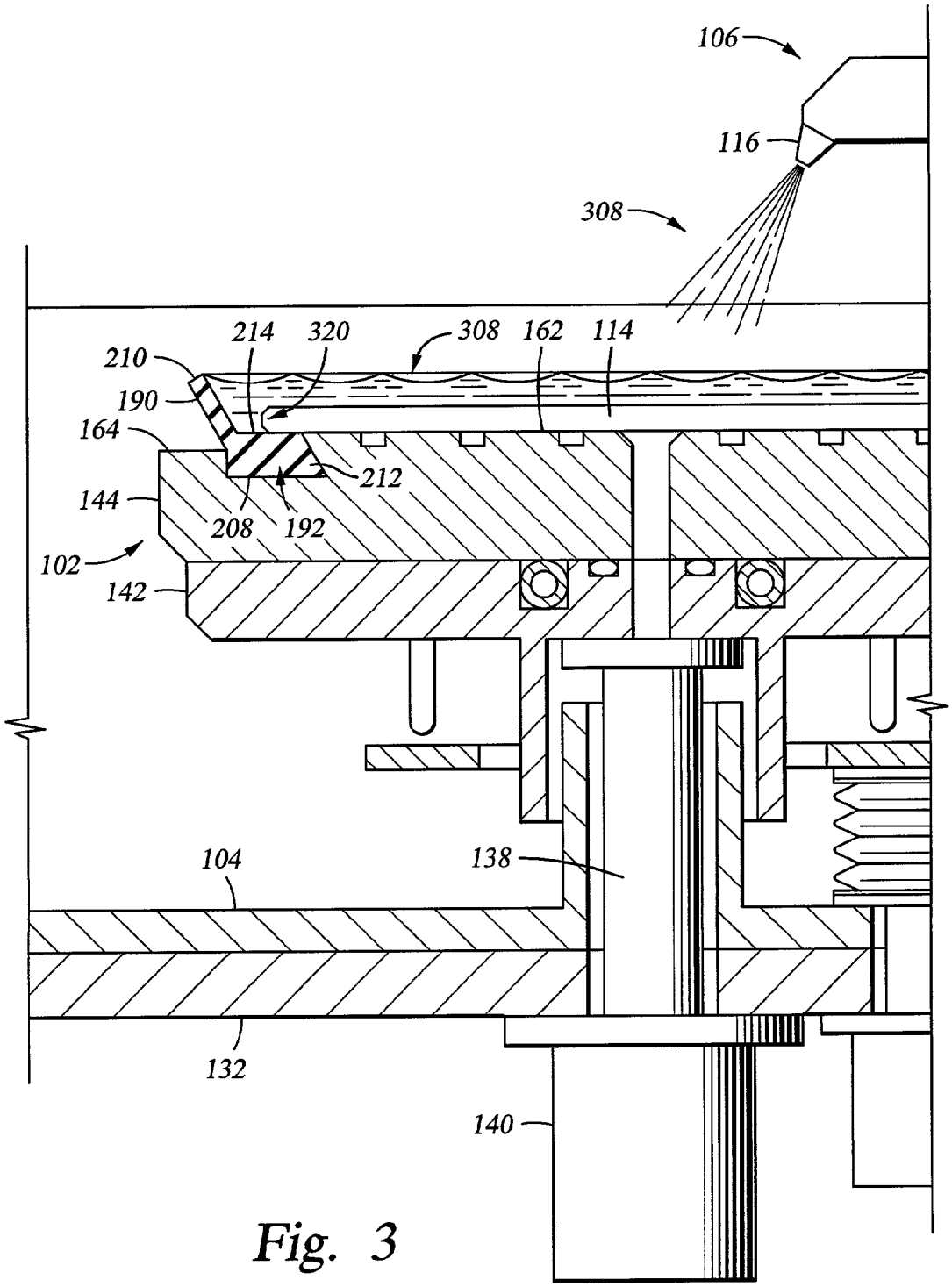
FIGS. 3 and 4 are partial sectional views of a substrate support during different stages of operation.
Figure 4:
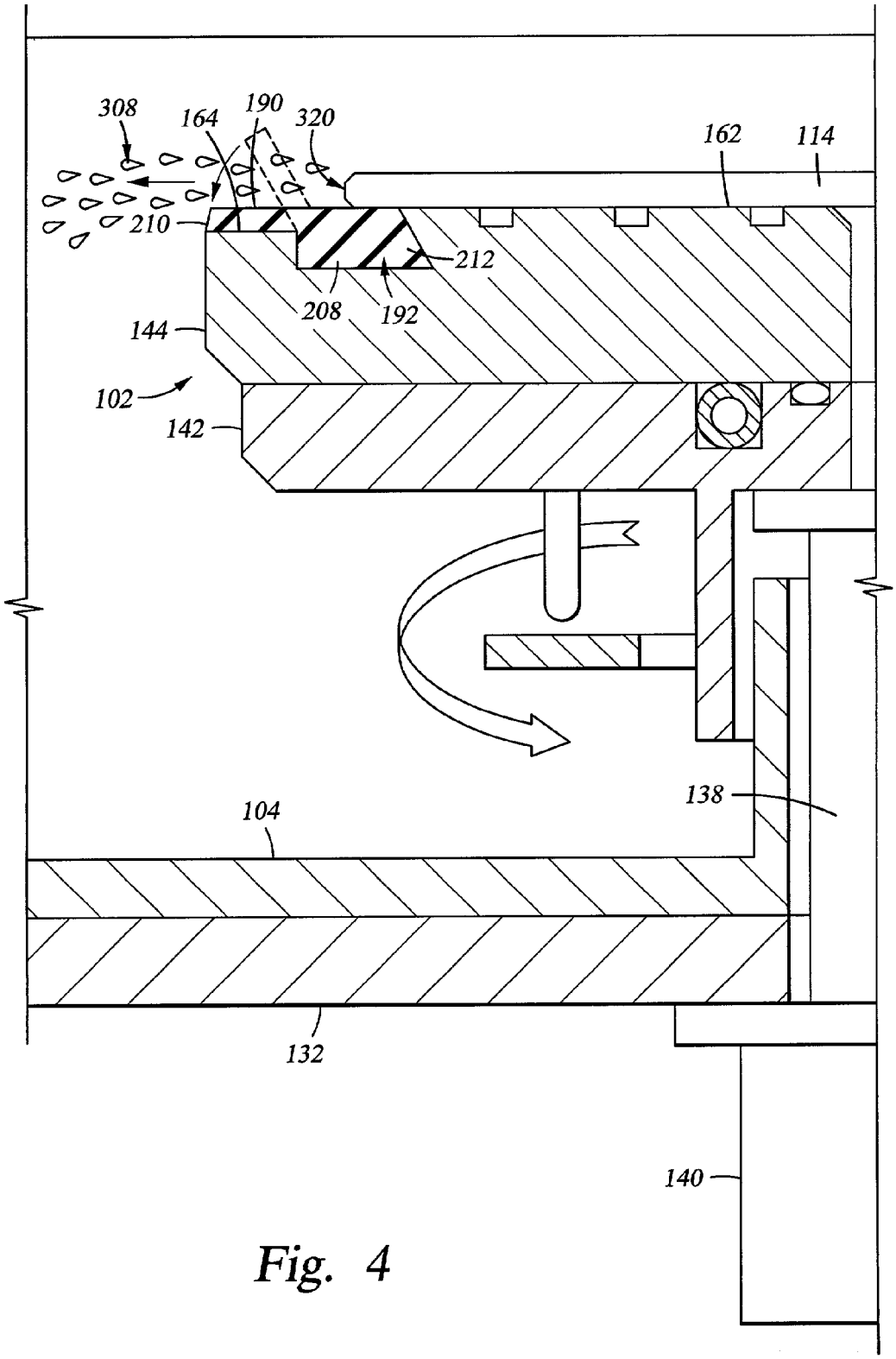

FIGS. 3 and 4 depict sectional views of the substrate support 102 during different stages of an electrochemical process. Electrolyte is provided to the surface of the substrate 114. The band 190, circumscribing the substrate 114 and sealingly coupled to the substrate support 102, retains the electrolyte above the substrate support 102, creating a shallow bath of electrolyte 308 for processing the substrate 114.

In the embodiment depicted in FIG. 3, the electrolyte 308 provided is saturated with metallic ions. The metallic ions generally attach to a layer of the substrate having an affinity thereto through an electroless plating process (i.e., a reduction reaction). The substrate 114 may be slowly rotated or oscillated to agitate the electrolyte 308 in contact with the substrate 114 to enhance processing uniformity. One electroless plating process that may be adapted to be performed in the cell 100 is described in U.S. patent application Ser. No. 10/059,851, filed Jan. 28, 2002, which is hereby incorporated by reference in its entirety.

After completion of the electrochemical process, the substrate support 102 is rotated to remove the electrolyte 308 from the substrate 114 as shown in FIG. 4. In one embodiment, the substrate support 102 is rotated in excess of about 1000 revolutions per minute. The centrifugal force generated by the rotating substrate support 102 causes the band 190 to deflect outwards and downwards, releasing the bath 308. In one embodiment, the second end 210 of the band 190 displaces to a position below the surface of the substrate 114. In another embodiment, the peripheral flange 164 is disposed at an elevation that allows the band 190 to recess below the central portion 162, thereby preventing electrolyte from being trapped between the band 190 and a perimeter 320 of the substrate 114 and effectively eliminating electrolyte from both the substrate 114 and substrate support 102. Freeing the substrate 114 and substrate support 102 from electrolyte advantageously reduces substrate contamination and scratching, thereby increasing productively.

Figure 5:
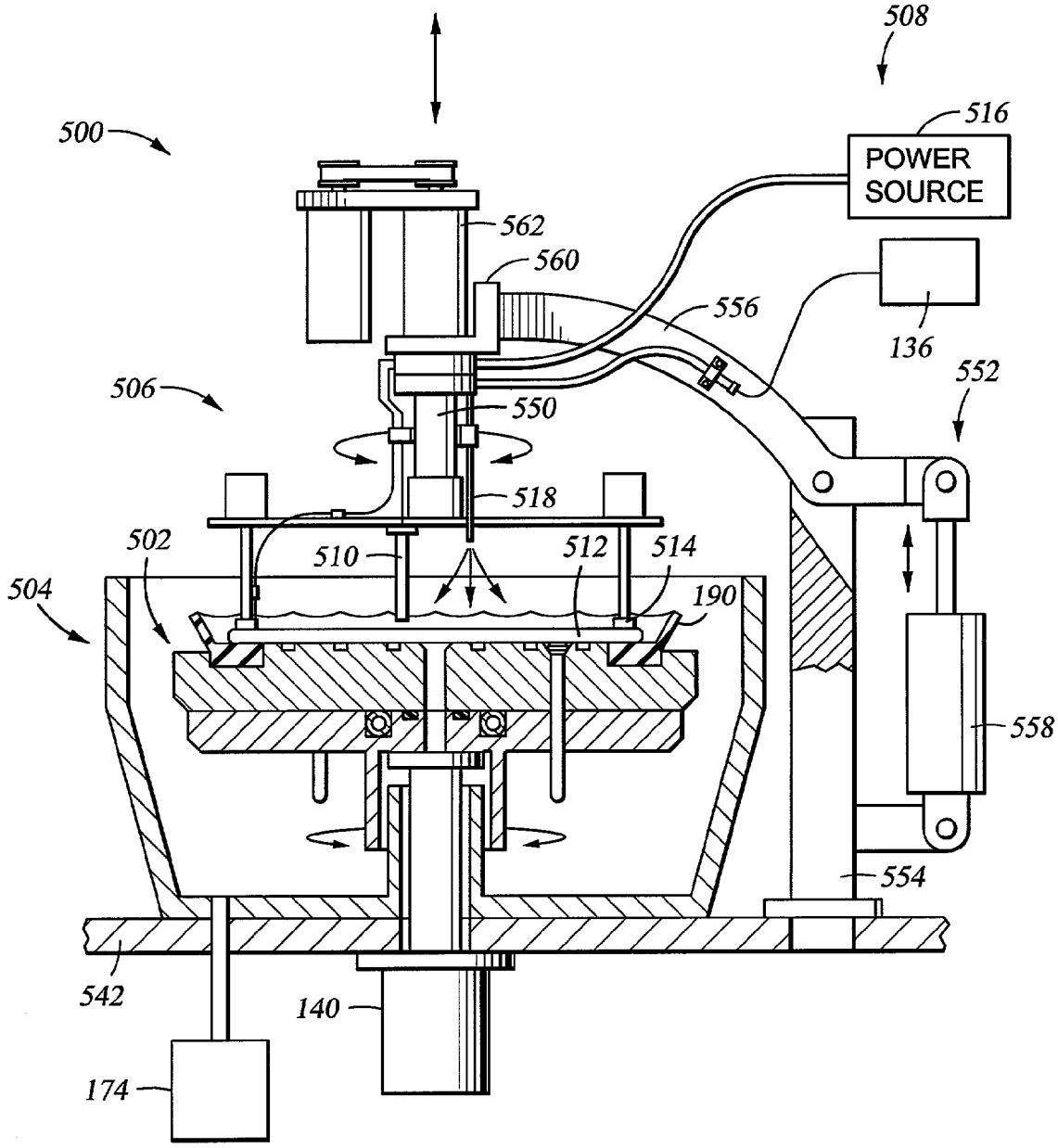
FIG. 5 is a sectional view of another embodiment of a processing cell.

FIG. 5 depicts another embodiment of a processing cell 500. The processing cell 500 includes a substrate support 502 disposed in a basin 504, and a head assembly 506 adapted to electrically contact a substrate 512 retained in an electrolyte bath on the basin 504. A biasing system 508 is adapted to apply a bias through the electrolyte between the substrate 512 and an anode 510 coupled to the head assembly 506 to drive a deposition process that results in deposition of conductive material on the substrate 114. Generally, the substrate support 502 and the basin 504 are similar to the substrate support 102 and basin 104 described above.

The head assembly 506 is mounted onto a head assembly frame 552. The head assembly frame 552 includes a mounting post 554 and a cantilever arm 556. The mounting post 554 is mounted onto a base 542 of the process cell 500, and the cantilever arm 556 extends laterally from an upper portion of the mounting post 554. Preferably, the mounting post 554 provides rotational movement with respect to a vertical axis along the mounting post to allow rotation of the head assembly 506.

The head assembly 506 is attached to a mounting plate 560 disposed at the distal end of the cantilever arm 556. The lower end of the cantilever arm 556 is connected to a cantilever arm actuator 558, such as a pneumatic cylinder, mounted on the mounting post 554. The cantilever arm actuator 558 provides pivotal movement of the cantilever arm 556 with respect to the joint between the cantilever arm 556 and the mounting post 554. When the cantilever arm actuator 558 is retracted, the cantilever arm 556 moves the head assembly 506 away from the basin 504. When the cantilever arm actuator 558 is extended, the cantilever arm 556 moves the head assembly 506 axially toward the basin 504 to position the substrate in the head assembly 506 in a processing position.

The head assembly 506 is coupled to a head assembly actuator 562 by a shaft 550 disposed through the mounting plate 560. The head assembly actuator 562 moves the head assembly 506 both vertically and rotationally.

The head assembly 506 includes a nozzle 518 coupled to an electrolyte source 136. The electrolyte source 136 generally pumps electrolyte to the substrate 512. The anode 510 and a contact ring 514 of the biasing system 508 are coupled to the lower end of the head assembly 506 facing the substrate support 502. The anode 510 is coupled to a power source 516. The anode 510 may be consumable and serve as a metal source in the electrolyte. Alternatively, the anode 510 may serve as a current source while the material to be electroplated is supplied within the electrolyte from the electrolyte source 136. The contact ring 514 is at least partially comprised of a conductive material and is adapted to electrically couple the substrate 512 to the power source 516.

As the substrate assembly actuator 562 places the head assembly 506 proximate the substrate 512, the contact ring 514 is seated against the substrate 512 and the anode 510 is immersed in the electrolyte volume retained above the substrate 512 by the band 190 extending from the substrate support 502. The power source 516 applies a potential across the contact ring 514 and anode 510. The electrolyte confined by the band 190 provides a current path between the substrate 512 biased by the contact ring 514 and the anode 510. Metallic ions, from the electrolyte and/or anode, are attracted to the substrate's surface by the electrical bias and deposit thereon. One example of an electroplating process that may be adapted to be performed in the cell 500 is described in U.S. patent application Ser. No. 09/739,139, filed Dec. 18, 2000, issued as U.S. Pat. No. 6,896,776 on May 24, 2005, which is hereby incorporated by reference in its entirety.

After completion of the electrochemical process, the head assembly 508 is lifted clear of the basin 504. The substrate support 502 is rotated to remove the electrolyte from the substrate 512 as shown in FIG. 4 with reference to the substrate support 102. The centrifugal force generated by the rotating substrate support 502 causes the band 190 to deflect outwards and downwards, releasing the electrolyte bath retained by the band 190.

Figure 6:
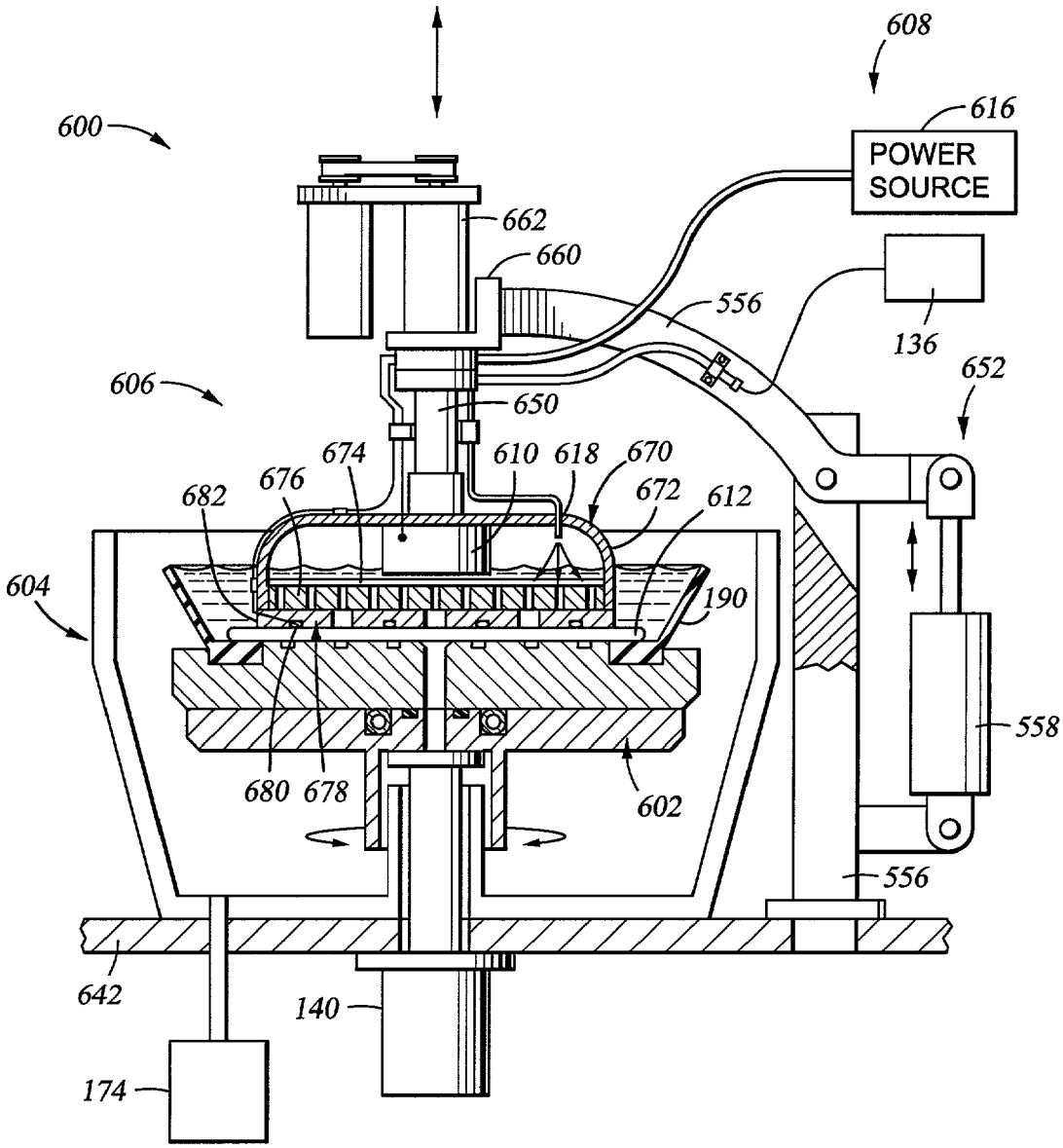
FIG. 6 is a sectional view of another embodiment of a processing cell.

FIG. 6 depicts another embodiment of a processing cell 600. The processing cell 600 generally includes a substrate support 602 disposed in a basin 604, and a head assembly 606 adapted to electrically contact a substrate 612 retained in an electrolyte bath on the basin 604. A biasing system 608 is adapted to apply a bias through the electrolyte between the substrate 612 and a cathode 610 coupled to the head assembly 606 to drive a dissolution or polishing process that results in deposition of conductive material on the substrate 114. Generally, the substrate support 602 and the basin 604 are similar to the substrate support 502 and basin 504 described above.

The head assembly 606 is mounted onto a head assembly frame 652. The head assembly frame 652 is similar to the head assembly frame 552 described above, and facilitates moving the head assembly 606 relative to the basin 604.

The head assembly 606 is attached to a mounting plate 660 disposed at the distal end of the head frame assembly 606. The head assembly 606 is coupled to a head assembly actuator 662 by a shaft 650 disposed through the mounting plate 660. The head assembly actuator 662 moves the head assembly 606 both vertically and rotationally.

The head assembly 606 includes a nozzle 618 and a polishing head 670. The polishing head 670 includes a housing 672 having the anode 610 disposed therein. A conductive pad assembly 678 is coupled to the end of the polishing head 670 facing the substrate 612 and basin 604. The pad assembly 678 generally includes a plurality of conductive elements 682 embedded in a dielectric polishing pad 680. One conductive pad assembly that may be adapted to benefit from the invention is described in U.S. patent application Ser. No. 10/033,732, filed Dec. 27, 2001, which is hereby incorporated by reference in its entirety.

The conductive pad assembly 678 is coupled to a backing 676. The backing 676 generally allows the compliance of the conductive pad assembly 678 to be tailored to suit a particular polishing application. The conductive pad assembly 678 and backing 676 are typically permeable or perforated or otherwise permeable to allow electrolyte to flow therethrough. The conductive elements 682 of the conductive pad assembly 678 and the cathode 610 of the biasing system 608 are coupled to a power source 616.

A membrane 674 is disposed between the backing 676 and cathode 610 to reduce bubble movement from the cathode 610 towards the substrate. In one embodiment, the membrane 674 is fabricated from TYVEK®.

A nozzle 618 is coupled to an electrolyte source 136 that provides electrolyte to the substrate 612. The nozzle 618 may be supported from the head assembly 606 or be coupled to an independent arm (not shown). The nozzle 618 generally flows electrolyte into a volume defined by the band 190 circumscribing the substrate 612 and coupled to the substrate support 602. The pool of electrolyte retained by the band 190 on the substrate 612 has a depth that floods the interior of the polishing head 670, typically through the pad assembly 678, and creates a current path between the substrate's surface contacted by the conductive elements 682 and the cathode 610.

As the substrate assembly actuator 662 places the head assembly 606 proximate the substrate 612, the cathode 610 disposed in the polishing head 670 is immersed in the electrolyte volume retained above the substrate 612 by the band 190 extending from the substrate support 602. The power source 616 applies a potential across the pad assembly 678 and cathode 610. The substrate 612 and pad assembly 678 are placed in relative motion to enhance polishing rate and uniformity. The electrolyte confined by the band 190 provides a current path between the substrate 612 biased by the conductive elements 682 of the pad assembly 678 and the cathode 610. Metallic ions are removed from the substrate's surface through an electrochemical dissolution process that can be optionally augmented with mechanical polishing activity. One example of an electrochemical polishing process that may be adapted to be performed in the cell 600 is described in U.S. patent application Ser. No. 10/038,066, filed Jan. 3, 2002, issued as U.S. Pat. No. 6,811,680 on Nov. 2, 2004, which is hereby incorporated by reference in its entirety.

After completion of the electrochemical process, the head assembly 608 is lifted clear of the basin 604. The substrate support 602 is rotated to remove the electrolyte from the substrate 612 as shown in FIG. 4 with reference to the substrate support 102. The centrifugal force generated by the rotating substrate support 602 causes the band 190 to deflect outwards and downwards, releasing the electrolyte bath retained by the band 190.

Thus, a band extending from a substrate support creates a shallow processing bath that substantially reduces the amount and cost of fluids utilized during processing. Particularly, when utilized in electrochemical processes, the usage of electrolyte is substantially reduced over conventional processes resulting in beneficial cost savings. The flexible elastic band allows for quick and efficient removal of electrolyte from the substrate and substrate support after processing. Moreover, as small volumes of electrolyte are needed during processing, faster fill and drain times enhance productivity and further reduce production costs.

While the foregoing is directed to the preferred embodiment of the present invention, other and further embodiments of the invention may be devised without departing from the basic scope thereof. The scope of the invention is determined by the claims that follow.

What is claimed is:

1. Apparatus for substrate processing, comprising:

a rotatable body having a center substrate support portion;

an elastomeric band circumscribing the center support portion and coupled to the body;

a drive adapted to rotate the body about its axis;

a fluid delivery system adapted to flow fluid into a volume defined by the band and the body, wherein the volume is sufficient to immerse a substrate;

a power source;

an electrode disposed above the body at an elevation less than an edge of the band and coupled to the power source; and at least one electrical contact coupled to the power source and adapted to bias a substrate seated on the center support portion relative to the electrode.

2. A substrate support comprising:

a rotatable body having a first side adapted to support a substrate;

a deformable annular band adapted to retain a liquid above the substrate when the substrate is seated on the first side of the body and to deflect to release the liquid upon the body being rotated at a predetermined rate;

a power source;

an electrode disposed above the body at an elevation less than an edge of the band opposite the first side of the body, the electrode coupled to the power source; and at least one electrical contact coupled to the power source and adapted to bias a substrate seated on the first side of the body relative to the electrode.

* * * * *